US005953976A

United States Patent [19]

Bueter

[11] Patent Number: 5,953,976

[45] Date of Patent: Sep. 21, 1999

[54] WORKING CYLINDER WITH DAMPENED ENDS

[75] Inventor: Josef Bueter, Haren/Ems, Germany

[73] Assignee: Buemach Engineering International B.V., Emmen, Netherlands

[21] Appl. No.: 09/047,880

[22] Filed: Mar. 25, 1998

[30] Foreign Application Priority Data

Apr. 10, 1997 [DE] Germany ..... 297 06 364

[51] Int. Cl.[6] ..... F15B 15/22

[52] U.S. Cl. ..... 91/1; 91/395; 91/397; 91/398

[58] Field of Search ..... 91/1, 243, 244, 91/394, 395, 397, 398, 407; 92/5 R

[56] References Cited

U.S. PATENT DOCUMENTS

| | | | |
|---|---|---|---|
| 2,556,698 | 6/1951 | Loewe | 91/395 |
| 3,157,095 | 11/1964 | Heiser | 91/395 |
| 4,176,586 | 12/1979 | Stoll et al. | 92/5 R |
| 4,207,800 | 6/1980 | Homuth . | |
| 4,316,145 | 2/1982 | Tamm | 92/5 R |
| 4,425,836 | 1/1984 | Pickrell . | |
| 4,899,643 | 2/1990 | Hvilsted et al. | 92/5 R |

FOREIGN PATENT DOCUMENTS

| | | | |
|---|---|---|---|
| 1 256 296 | 2/1970 | Germany . | |
| 694 37 65 | 3/1970 | Germany . | |
| 1 925 166 | 11/1970 | Germany . | |
| 2 206 410 | 8/1973 | Germany . | |
| 94 18 042 U | 2/1995 | Germany . | |
| 182604 | 7/1989 | Japan | 91/397 |

*Primary Examiner*—F. Daniel Lopez
*Attorney, Agent, or Firm*—Michael J. Striker

[57] ABSTRACT

An end dampened working cylinder for a fluid which serves as a fluid power medium for transmission of energy, the working cylinder comprising a main piston; control plungers carrying ring magnets and mounted on both sides of the main piston; springs form-locking the control plungers with the main piston and piston rod; sensors incorporated in a topside end and a bottom end and reacting to a contactless magnetic field, so that on approaching the ring magnet but at least on reaching a sealing rest position of the control plunger at each of the end stops a signal of a respective one of the sensors is generated and serves for controlling the fluid power, the control plungers sliding along the piston rod so as to provide adjustable and guaranteed sealing, outlet channels and a throttled flow-off channel, the control plungers serving as a shut-off component and valve for the outlet channels, so that when the control plungers rest on the topside end and the bottom end a dampening space is formed, from which a dampened fluid outlet through the throttled flow-off channel provides an external means of adjustment in form of a throttle adjustment screw.

8 Claims, 4 Drawing Sheets

WORKING CYLINDER WITH DAMPENED ENDS

BACKGROUND OF THE INVENTION

The present invention relates to a working cylinder with dampened ends, which may be deployed in the areas of fluid technology where the ends require dampening.

Systems are known where the suppressing of the main piston of a working cylinder at each stroke end is performed by a reduction of the flow cross section area for the outlet fluid power, complemented in many cases by a pressure regulating valve which can externally set. In terms of construction a very wide range of designs exists. They can be divided into systems which display the throttled outlet cross section as stationary parts of the working cylinders, or systems where the dampening throttle is incorporated in the moving parts of the cylinder. The basic function of the dampening is aimed at decelerating the total kinetic energy of the moving parts of the cylinder for keeping the impact energy as low as each individual application allows. The function of a cross section reduction in the course of the movement of the piston towards the end—from the time when the dampening commences—determines piston towards the ends—from the time when the dampening commences—determines the dampening characteristics. There are known dampening systems which abruptly seal off the discharge cross section and conduct the flow via the throttle cross section or systems where the dampening is performed progressively in the sense of a gradual adjustment to the resting state of the piston, whereby the throttle cross section is gradually reduced in the course of the piston movement.

This is supported by some publications. The publication DE-OS 1925166 refers in its description on the state of art to the publication DE-AS 1256296 where a special dampening element is described whereby publication DE-AS 1246296 where a special dampening element is described whereby the piston pushes the pressure medium through a narrow gap and acts as a pressure controlled dampener on the piston.

There is also a description of a check valve in the piston as well as check valves in the small cross section outlets in the cylinder barrel wall over a part which is passed by the piston. In doing so a special, locally controlled contour function is implemented in such a manner that the cross section of the outlet is ideally proportionate to the square of the stroke.

Publication DE-G 6943765 describes an outlet for the pressure medium in front of the cylinder end for dampening purposes, in which the outlet leads into the inlet supply line of the working cylinder. An annular gap which is created by an undersized ring with a gap between it and the cylinder acts as a pressure controlled dampening element. Additionally, there is an annular grove in the piston as well as a check valve between the annular groove and the cylinder chamber within the piston for directional control.

In publication DE-OS 2206410 a dampening via a throttle valve in the pressure medium outlet is described, into which an extension of the piston is extended, as well as a check valve in the piston itself. In accordance with the invention the dampening is achieved here through a special shape of piston whereby an undersized ring with accessible space forms a common space with the cylinder. The outlet pressure medium from the latter is throttled and the dampening cross section corresponds to the piston cross section.

Publication U.S. Pat. No. 4,207,800 achieves dampening with the help of a special piston ring which sits at the end of the piston, has some axial movement and is somewhat undersized, whereby ac heck valve is formed by the unilaterally broken surface of the ring and by compressing of the pressure medium in the cylinder chamber a pressure controlled dampening by means of the annular gap is achieved.

An equally simple dampening is described in the publication U.S. Pat. No. 4,425,836. Here the dampening is achieved through an annular groove located between the piston and the cylinder. In this way it is a functional of the dampening as the effective spiral extends as the piston approaches the end.

Publication DE -G 9418042.3 describes a remnant cylinder space as a dampening component by means of a secondary pressure medium cylinder which functions directly as a damper. Superimposed on this a pressure controlled dampening takes place by means of the annular gap incorporated into the undersized piston ring, as well as a position controlled dampening via the effective length of the spiral groove which increases towards its end. In this case the spiral groove is positioned in the stroke area of the piston ring.

The drawback in all the described variations is the high level of constructive expenditure on achieving a deceleration of the moving masses without an impact. No simple construction for adjusting the appropriate dampening to the concrete application is available.

Traditionally, the dampening follows the function:

$$P_2 \times z \geqq W_k \pm W_p$$

wherein:

$P_2$=dampening pressure, Z=cylinder constant, $W_k$=kinetic energy, $W_d$=pressure energy of the dampening distance, $W_p$=potential energy of the position.

In order to achieve the desired dampening effect—while simultaneously maintaining the required operating power—$p_2$ must be increased.

This takes place via:

a) by increasing of the operating pressure, since then $p_2$ as the dampening dynamic pressure can be increased evenly. or b) by enlarging the working cylinder, since the dynamic pressure of the throttle can be increased.

Both versions are inefficient in terms of energy and in the case of a sudden reduction of the cross section can create a hazard by a oscillating deceleration of the masses. These dampening variations warrant no timing related positioning of the dampening. In aiming at a progressive dampening the high level of constructive expenditure dominates and becomes often commercially unviable.

SUMMARY OF THE INVENTION

It is therefore an object of the present invention to provide a working cylinder with dampened ends which eliminates the drawbacks in the state of art, in which the technical and constructive effort required to guarantee the dampening is minimal, and in which the deployment related adjustment of the dampening is achieved simply.

It is another object of the present invention to eliminate the wear and tear of the construction parts effecting the dampening.

It is a further object of the present invention to design the working cylinder so that damper should operate smoothly and safely even under full load, whereby the dampening is to be regulated by external means.

It is a further object of the present invention to design the working cylinder so that the dampening should be used in all areas of fluid power (liquid and gases) applications, in cases of working cylinders requiring end dampening.

In keeping with these objects and with others which will become apparent hereinafter, one feature of present invention resides, briefly stated, in an end dampening working cylinder for a fluid which serves as a fluid power medium for transmission of energy, the working cylinder which has a main piston; control plungers carrying ring magnets and mounted on both sides of said main piston; springs form-locking said control plungers with said main piston; and a piston rod; sensors incorporated in a top side and stop a bottom end and reacting to a contactless magnetic field, so that on approaching said ring magnet but at least on reaching a sealing rest position of said control plunger at each of said end stops a signal of a respective one of said sensors is generated, and serves for controlling the fluid power, said control plungers sliding along said piston rod so as to provide adjustable and guaranteed sealing; means forming outlet channels and a throttled flow-off channel, said control plunger serving as a shut-off component and a value for said outlet channels, so that when said control plungers rest on said top side end and said bottom end, a dampening space is formed, from which a dampened fluid outlet through said throttled flow-off channel provides an external means of adjustment in form of a throttle adjustment screw.

The advantages of the invention are that the technical and constructive expenditure to warrant the dampening is simple, that the technical and constructive expenditure to warrant the deployment related dampening is simple, the dampening is achieved without additional sealing elements and thereby an additional wear of constructive parts is eliminated, the dampening operates smoothly and safely even under full load and is adjustable by external means, the dampening can be used in all areas of fluid power applications (liquids and gases) in application in which working cylinders requiring end dampening, that the directional reversal of the motion of the fluid driving the main piston can be induced fully or by pulsation.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
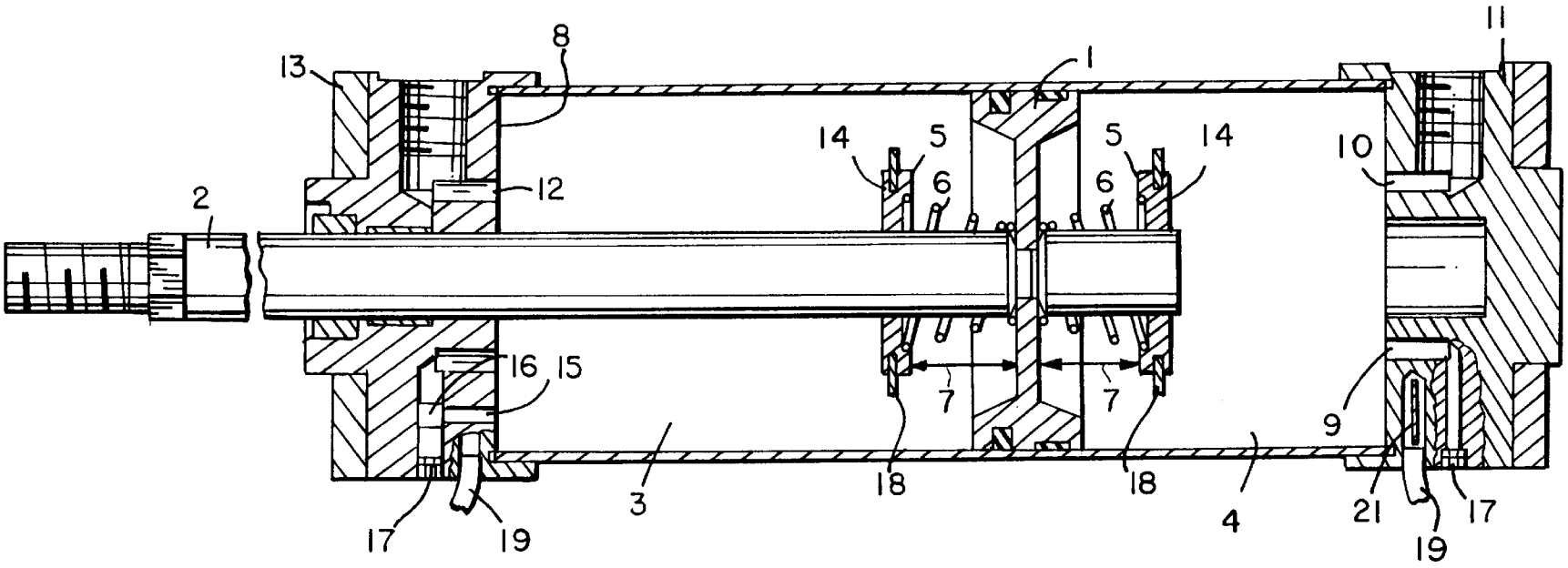
FIG. 1 as a cross section through a working cylinder of the invention with a piston in mid-position.

As can be seen from FIG. 1 a control plunger 5, is mounted co-axially with the main piston 1 onto a piston rod 2, also in the adjoining cylinder spaces 3 and 4, by means of a conical spiral spring 6 which is form-locked with the piston rod 2 and the control plunger 5. The forward stroke span of the control plunger 5 equates at the same time to a dampening track 7 which is generated in the course of the movement of the main piston 1 in the direction of the bottom and top end-stops 8 and 9.

Figure 2:
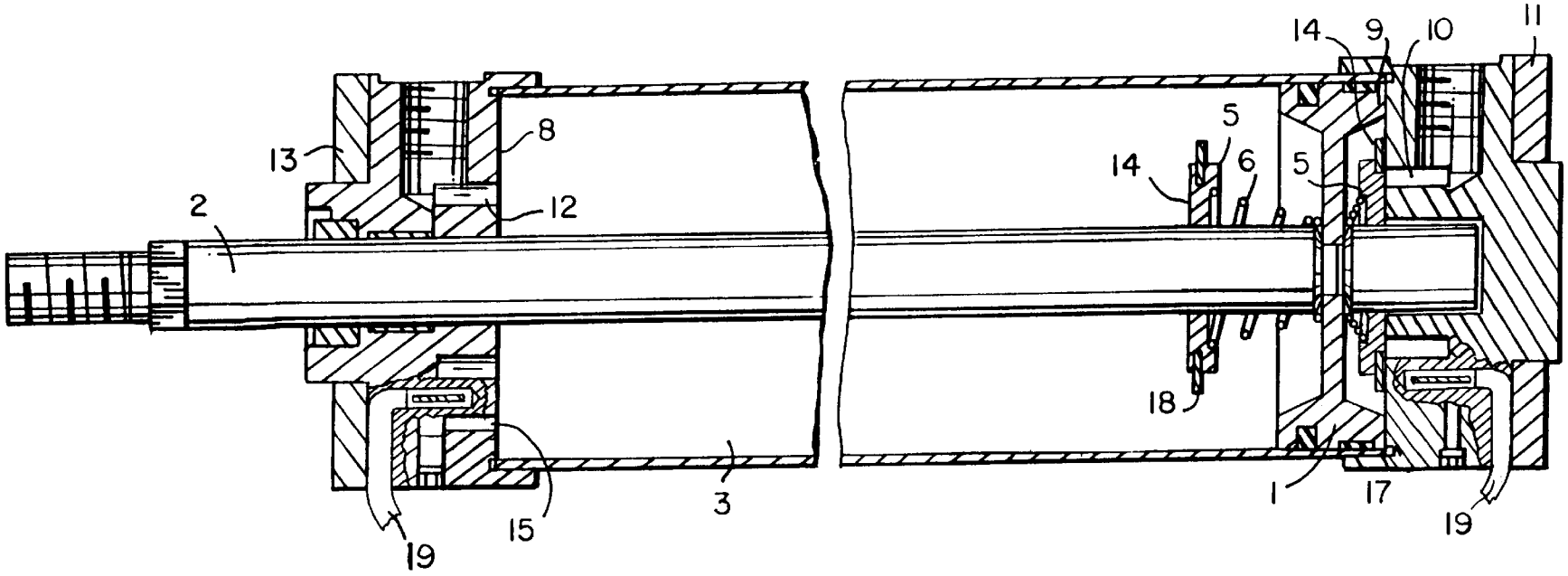
FIG. 2 as at the bottom end position of the piston with axially built-in sensor.

The control plunger position ahead seals off according to FIG. 2, depending on the direction of its movement, the outlet channel I 10 of a base 11, or the outlet channel II 12 of the top 13, by contracting of a control plunger mounting 14 at the bottom end 9, or at the topside end 8. With each contact care is taken that a throttled flow-off channel 15 remains free, which is not shown in the drawing of the base 11 for technical reasons.

Figure 4:
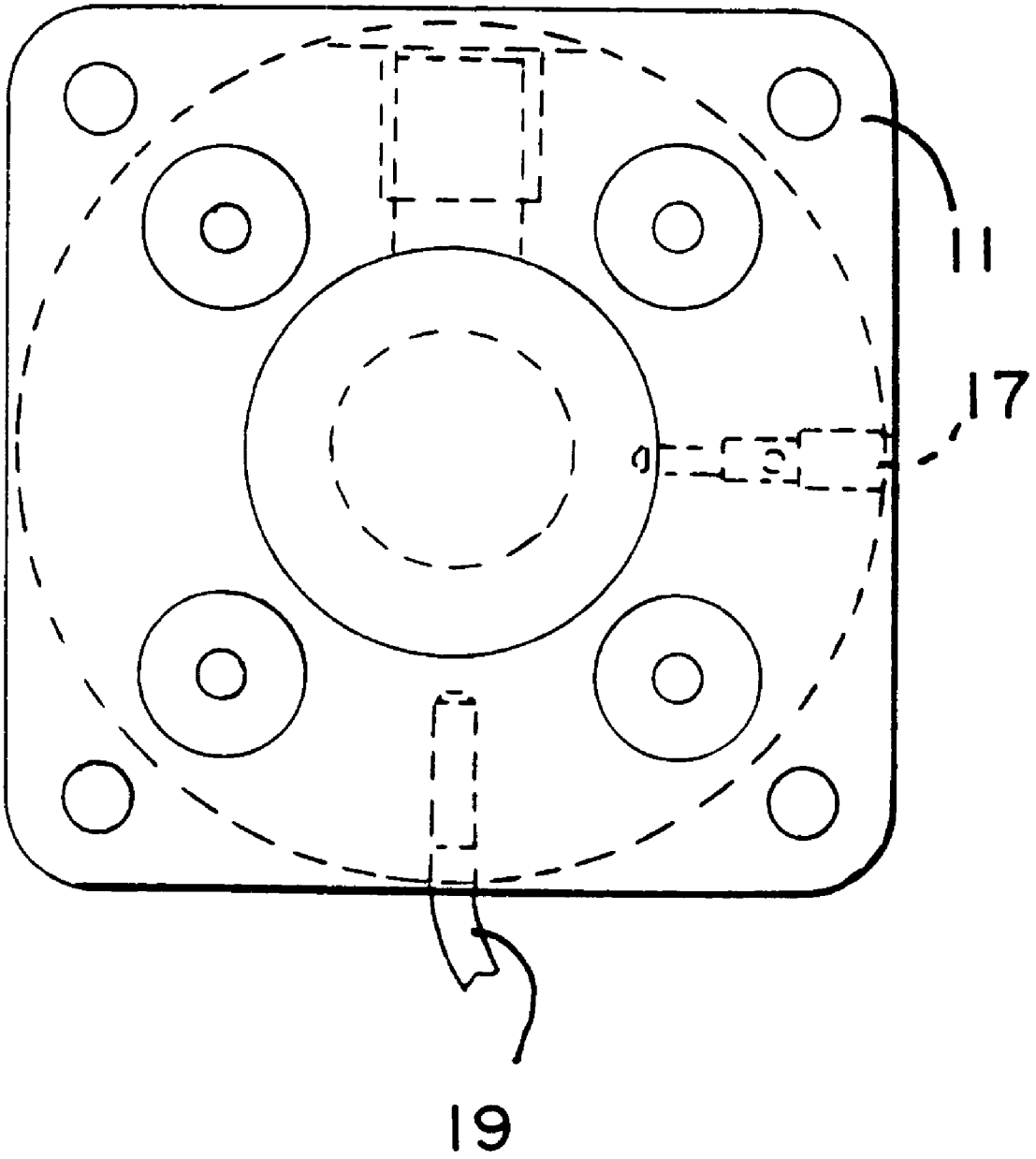
FIG. 4 as a side view of the working cylinder with radially built-in sensor and adjusting screw for the throttled outlet.

As can be seen from FIG. 1 the throttled flow-off channel 15 has a radially positioned, drilling 16, which features a thread, and in which a throttle adjustment screw 17 is located. By means of the adjustment of the throttle screw 17 and the dampening fluid pressure can be influenced (see also FIG. 4).

Figure 3:
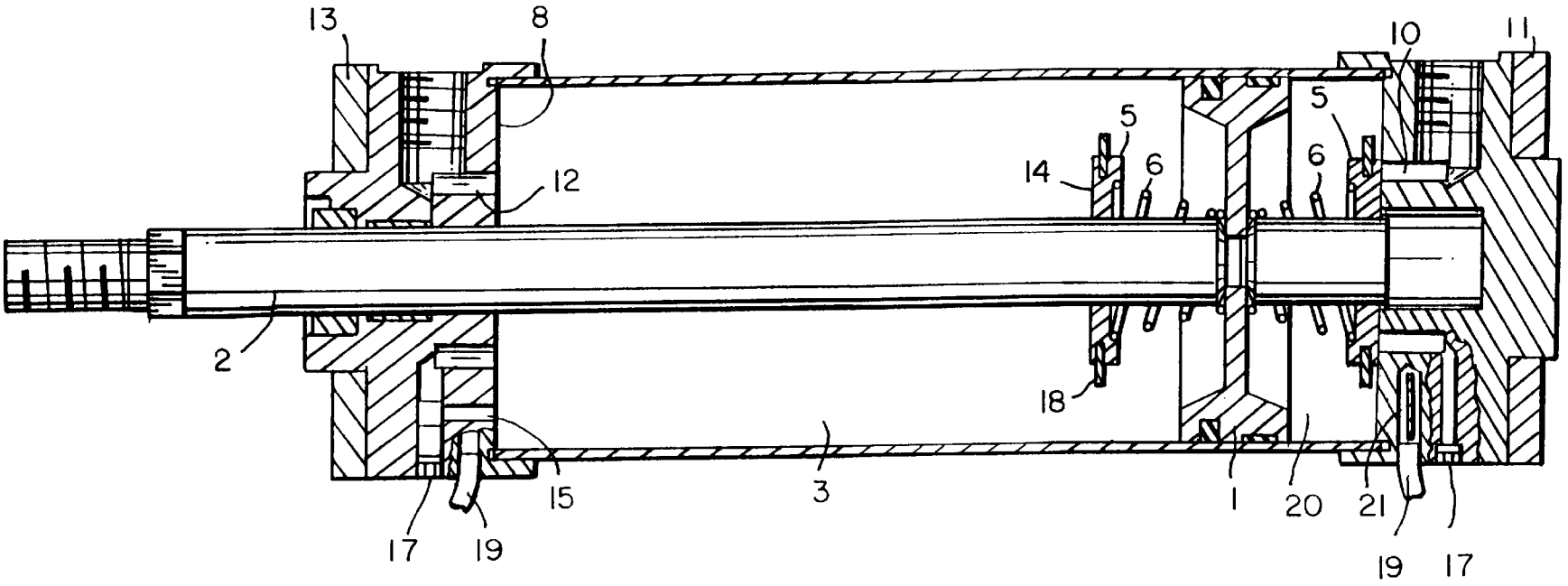
FIG. 3 as at the bottom end position of the piston with radially built-in sensor and showing the dampening space.

As can be seen from FIG. 1, FIG. 2 and FIG. 3 the control plunger (5) is also the carrier of the ring magnet 18, the lines of electric flux of which serve to activate the sensors 19 mounted in the cross section of the outlet channels I and II 10, 12 whereby a signal is given which initiates the directional reversal of the fluid power. The activating the sensor 19 is done without contact. In the switching process the directional valve units which are normally found in hydraulic systems are activated and introduce a directional switch of the fluid power. The fluid inflow serving the motional direction of the piston is thus blocked in favor of the inflow into the cylinder space 3 or 4, in which, according to FIG. 3, a dampening space 20 is formed through the flat resting of the control plunger mount 14 at the bottom or the topside ends 8 or 9, and at the same time a pressure head is formed. In this way a counterpressure which influences the dampening can be superimposed on the dynamic pressure forming inside the dampening cross section 20, within the cylinder spaces 3 or 4, depending on the ratio of the cross-section of the outlet channel I 10 or the outlet channel II to the cross-section of the throttled flow-off channel. In this way the dampening can be adjusted using the throttle adjustment screw 17 and the setting of the fluid pressure.

The timing of the signal for the purpose of switching the directional is pre-determined through the selection of the length of the conical spiral spring 6 which also determines dampening track 7, as shown in FIG. 1. The duration of the signaling by the sensor 19 is simultaneously dependent on this dampening track 7 and the speed of the main piston 1. Depending on the main characteristics of the working cylinder and its practical deployment the characteristic dampening curve can be influenced on a constructive level, simply by the selection of the conical spiral spring 6. By varying the determining characteristics in his manner a wide field of application can be accessed with low constructive efforts.

The positioning of the sensor 19 is exclusively dependent on the intensity of the magnetic field on the one hand and its accessibility in practical use on the other. In order to prevent the influence of magnetic stray fields on the time of the signaling, the order to prevent the influence of magnetic stray fields on the time of signaling, the sensors 19 are stored in a paramagnetic casing 21 as shown in FIG. 3.

The object of the invention in FIGS. 1–4 is that the control plunger 5 is mounted adjacent to the main piston 1 of the working cylinder and on its control plunger mounting 14 carries the ring magnet 18 which enables the contactless signaling by means of the magnetic field of its permanent magnet. The control plunger 5 consists of a paramagnetic material (primarily austentic chrome nickel steel) or a fluid-resistabnt plastic material which corresponds to the static load (polyamide, polyvinylchloride, polytetrafluorethylene or phenolic resins with fillers). Here, the positioning of sensor 19 is dependent on the application, whereby a radial or an axial version is possible with regard to the positioning of the piston rod 2.

The advantages of this type of dampening are that the timing of the signal is simply predetermined on a constructive level by the size of the distance advanced of the control plunger 5 via the conical spiral spring 6 which is the dampening track 7 and that the signal of sensor 19 is given independently of the speed of the main piston 1 by the dampening track 7. The timing of the signal is determined by the interaction of the magnetic field of the ring magnet 18 on the sensor 19 which occurs when the ring magnet 18 rests at the ends 8 or 9. The dampening of motion of the main piston 1 and the simultaneous direction of the fluid power are coupled. The dampening occurs without additional dampening elements thus excluding wear and tear of the same. The dampening operates smoothly and efficiently, even under full load. The encapsulated installation of the sensor 19 into the stationary part of the end-stops 8 and 9 of the working cylinder offers a protection which rules out all damage, that the dampening is externally adjustable by means of the throttle adjustment screw 17. The control plunger 5 has a valve function with the outlet channels I, II 10, 12, that the dampening can be used in all areas of fluid power technology, in cases of working cylinders requiring end dampening. By the control of the fluid directions the change in the direction of movement of the main piston 1 is induced or that an actively controlled dampening is introduced by an impulse switching of the fluid direction which initiates a rise of the dampening pressure.

The superimposed external pressure can, however, only be effective when the counter-pressure which switches itself on in the inner dampening area is less or equal to it. If the internal pressure corresponds to the operating pressure a compensation of the pressure energy occurs which acts alongside the dampening track. The advantage of this solution over the solutions presented in the prior state of art can be clearly perceived from the mathematical relationship.

Assuming that $P_2=P_B$, it follows that $$P_2=m(v^2+2\times g\times 1_D)\times(2\times z)^{-1}$$

if the external pressure is greater than $P_B$, i.e. $P_A=P_B+\Delta P_A$, then it follows that:

$$2(P_2\times Z+\Delta P_A\times 1_D\times A)=m(v^2+g\times 1_D\times 2)$$

wherein $p_2$=dampening dynamic pressure, $P_B$=operating pressure, $P_A$=external pressure which is superimposed for dampening, m=system mass set in motion, V=speed of masses set in motion, $1_D$=dampening track, z=parameter relating to a working cylinder, g=acceleration due to gravity, A=surface of the main piston,. $p_2$ is determined by the polytropic change of state if the external differential pressure superimposes itself onto a gaseous fluid.

As can be seen from this, the dampening principle is different from traditional and known systems in that a) the operating pressure of the main piston for the length of the dampening track is at the least compensated b) with higher external pressure an additional counter-pressure comes into effect.

In the quantity characterized by "z", the formation of dynamic pressure occurs as a function of the geometrical size of the working cylinder and its outlet conditions. In cases where the dampening principle is applied to compressible fluids depending on the value of the polytropic change of state of the system, this is corrected by the outlet ratio of the throttled outlet cross-section to the unthrottled cross-section, and in cases of application to non-compressible fluids depending on the back-pressure as a result of the outlet ratio.

By the positioning of a sensor 19 in each of the ends 8; 9 of the main piston 1 of the working cylinder a signal is given in the way presented, the command of which results in the introduction of the counter-switching of an external fluid power. The control plungers 5 passing ahead of the main piston 1 of the working cylinder are positioned co-axially to the piston rod 2 and are form-locked at a defined distance to the mounts of the main piston 1 through the conical spring 6. Thereby the distance to the control plunger mount 14 is given at the same time, which for purposes of space-saving receives such a clearance that the conical spring 6, which acts as a coupling element between the main piston 1 and the control plunger 5, as well as the control plunger 5 itself, can be included in this clearance. In the course of the movement the passing control plunger 5 is used at the same to close the outlet channel I or II for the fluid. Thereby the outlet of the fluid is then only possible via the throttled cross-section. As a result of the reduction of the cross-section the desired dampening dynamic pressure of the inner system of the working cylinder occurs. Onto this dampening dynamic pressure, a pressure belonging to the external system is superimposed, which corresponds at the least to the operating pressure.

Here the signal for the introduction of the fluid into the dampening space 20 of the inner system is given simultaneously to the closing of the outlet channel 10 or 12 by the control plunger (5), as a result of the magnetic potential of the non-contact sensor 91, whereby depending on the type of circuit a) either the reversal of the fluid's direction of flow in relation to the direction of movement of the main piston 1 or b) an impulse-driven counter-switching of the fluid's direction of flow for controlled dampening, whereby depending on the duration of the impulse an intensity regulation of the latter occurs.

In both cases an influence is exerted on the inner dynamic pressure, which allows for its dampening characteristic curve to be controlled.

It will be understood that each of the elements described above, or two or more together, may also find a useful application in other types of constructions differing from the types described above.

While the invention has been illustrated and described as embodied in working cylinder with dampened ends, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An end dampened working cylinder for a fluid which serves as a fluid power medium for transmission of energy, the working cylinder comprising a main piston; control plungers carrying ring magnets and mounted on both sides of said main piston; springs form-locking said control plungers with said main piston and a piston rod; sensors incorporated in a topside end and a bottom end and reacting to a contactless magnetic field, so that on approaching said ring magnet but at least on reaching a sealing rest position of said control plunger at each of said end stops a signal of a respective one of said sensors is generated, and serves for controlling the fluid power, said control plunger sliding along said piston rod so as to provide adjustable and guaranteed sealing; means forming outlet channels and a throttled flow-off channel, said control plungers serving as a shut-off component and a valve for said outlet channels, so that when said control plungers rest on said topside end and said bottom end stop, a dampening space is formed, from which a dampened fluid outlet through said throttled flow-off channel provides an external means of adjustment in form of a throttle adjustment screw.

2. An end dampened working cylinder as defined in claim 1; and further comprising a paramagnetic casing, said sensors being mounted radially within said paramagnetic casing into each of said ends so that a signal-releasing magnetic potential is given by said ring magnet mounted on said control plungers.

3. An end dampened working cylinder as defined in claim 1; and further comprising a paramagnetic casing, said sensors being mounted axially within said paramagnetic casing into each of said ends so that a signal-releasing magnetic potential is given by said ring magnet mounted on said control plungers.

4. An end dampened working cylinder as defined in claim 1, wherein said control plungers have a mount, said ring magnet being positioned on said mount of said control plungers.

5. An end dampened working cylinder as defined in claim 1, wherein said main piston has an end provided with a cavity, said control plunger and said conical spring being accommodated in said cavity of said main piston.

6. An end dampened working cylinder as defined in claim 1; and further comprising means forming a dampening track which is activateable by changing a length of said spring acting as a form-locked coupling element, said spring being formed as a conical spiral spring.

7. An end dampened working cylinder as defined in claim 1; and further comprising means for controlling a flow direction of the fluid for providing a targeted influence of a controlling counter-pressure for regulated dampening in relation to an energy to be dampened, in order to achieve a desired dampening characteristic curve.

8. An end dampened working cylinder as defined in claim 1; and further comprising means for reversing a flow direction of the fluid for providing a targeted influence of a controlling counter-pressure for regulated dampening in relation to an energy to be dampened, in order to achieve a desired dampening characteristic curve.

* * * * *